US006910801B2

(12) United States Patent
Sasaki

(10) Patent No.: US 6,910,801 B2
(45) Date of Patent: Jun. 28, 2005

(54) AGITATING AND MIXING DEVICE

(75) Inventor: Hiroyasu Sasaki, Iwatsuki (JP)

(73) Assignee: Umeda Industry Co., Ltd., Iwatsuki (JP)

( * ) Notice: Subject to any disclaimer, the term of this patent is extended or adjusted under 35 U.S.C. 154(b) by 101 days.

(21) Appl. No.: 10/101,624

(22) Filed: Mar. 21, 2002

(65) Prior Publication Data

US 2002/0145938 A1 Oct. 10, 2002

(30) Foreign Application Priority Data

Apr. 5, 2001 (JP) ..... 2001-107493
Sep. 12, 2001 (JP) ..... 2001-276455

(51) Int. Cl.[7] ..... B01F 9/02
(52) U.S. Cl. ..... 366/220; 366/225; 366/228
(58) Field of Search ..... 366/219, 220, 366/225, 226, 228, 229, 230, 231, 236, 222, 213; 118/418; 422/209

(56) References Cited

U.S. PATENT DOCUMENTS

| | | | | | |
|---|---|---|---|---|---|
| 75,129 | A | * | 3/1868 | Custer | 366/222 |
| 122,357 | A | * | 1/1872 | Butt | 366/220 |
| 160,413 | A | * | 3/1875 | Forbes | 366/222 |
| 302,420 | A | * | 7/1884 | McKeage et al. | 366/226 |
| 338,673 | A | * | 3/1886 | Mowrer | 366/228 |
| 438,287 | A | * | 10/1890 | Hawkins | 209/298 |
| 466,671 | A | * | 1/1892 | Gale | 366/220 |
| 621,521 | A | * | 3/1899 | Canning | 366/228 |
| 621,563 | A | * | 3/1899 | Gilbert | 366/214 |
| 662,616 | A | * | 11/1900 | Wilson | 366/236 |
| 714,315 | A | * | 11/1902 | Lybrink | 366/228 |
| 849,540 | A | * | 4/1907 | Garred | 366/213 |
| 849,688 | A | * | 4/1907 | Kaplan | 366/222 |
| 941,267 | A | * | 11/1909 | McRae | 366/230 |
| 1,002,347 | A | * | 9/1911 | Wemer | 366/213 |
| 1,328,119 | A | * | 1/1920 | Brayman | 366/220 |
| 1,434,932 | A | * | 11/1922 | Uccellini | 366/222 |
| 1,755,763 | A | * | 4/1930 | Barber | 366/213 |
| 2,200,514 | A | * | 5/1940 | Mitchel et al. | 366/236 |
| 2,241,734 | A | * | 5/1941 | Petersen | 71/9 |
| 2,376,106 | A | * | 5/1945 | Witthofft | 366/220 |
| 2,867,107 | A | * | 1/1959 | Brown | 68/24 |
| 3,041,148 | A | * | 6/1962 | Ballantyne et al. | 422/209 |

(Continued)

FOREIGN PATENT DOCUMENTS

| | | |
|---|---|---|
| DE | 196 40 740 | 4/1998 |
| DE | 199 03 748 | 9/2000 |
| FR | 912.324 | 8/1946 |
| GB | 1132841 | 1/1966 |
| GB | 2 065 854 | 7/1981 |

OTHER PUBLICATIONS

Copy of European Patent Office Communication including European Search Report for corresponding European Patent Office Application No. 02006582.7 dated Jul. 22, 2002.

Copy of European Patent Office Communication including European Search Report for corresponding European Patent Office Action 02006582 dated Oct. 2, 2002.

*Primary Examiner*—Tony G. Soohoo
(74) *Attorney, Agent, or Firm*—Westerman, Hattori, Daniels & Adrian, LLP

(57) ABSTRACT

The object of the present invention is to provide a device with a simple structure which can uniformly mix bulk materials.

A device comprises a rotary shaft 6 to be rotated by a driving means 3, a container outer shell 7 fixed to the rotary shaft 6 to tilt relative to the rotary shaft 6, and an inner shell 9 fixed inside the container outer shell 7. Bulk materials are put into a receiving space 13 formed between the container outer shell and the inner shell and are then agitated and mixed.

3 Claims, 19 Drawing Sheets

U.S. PATENT DOCUMENTS 3,090,604 A * 5/1963 Wheeler ..... 366/213
3,188,058 A 6/1965 Locke ..... 259/89
3,280,604 A * 10/1966 Panker ..... 68/146
3,371,913 A * 3/1968 Muench ..... 366/220
3,570,273 A * 3/1971 Hertig ..... 68/23.1
4,664,527 A 5/1987 Schuler ..... 366/141
4,797,004 A 1/1989 Buschbom ..... 366/186
4,971,449 A 11/1990 Hendren ..... 366/228
5,074,057 A 12/1991 Kanai ..... 34/179
5,249,860 A 10/1993 Buschbom et al. ..... 366/135
5,261,744 A 11/1993 Brunn ..... 366/217
5,556,202 A * 9/1996 Dorn ..... 366/220
5,589,391 A * 12/1996 Fink ..... 435/290.3
5,971,602 A * 10/1999 Dorn ..... 366/230
6,401,362 B1 * 6/2002 Schultz et al. ..... 34/499

* cited by examiner

AGITATING AND MIXING DEVICE

BACKGROUND OF THE INVENTION

The present invention relates to a device for agitating and mixing two or more kinds of bulk materials, for example, raw materials of cement, row materials of chemicals, raw materials of pharmaceuticals, ceramics, raw materials of cosmetics, raw materials of metals, fertilizers, feeds, raw materials of paints, raw materials of foods, sludge, and magnetic abrasives.

Commonly known as conventional agitating and mixing devices are a type in which bulk materials are put into a container and the container is rotated and revolved and a type comprising agitating blades in a container for mixing bulk materials.

However, the former type has a problem of its complex structure and the latter type has problems that it is difficult to uniformly mix bulk materials and considerable labor is required for maintenance, for example, cleaning the agitating blades.

The present invention is made for the purpose of solving the aforementioned problems and the object is to provide an agitating and mixing device with a simple structure which can uniformly mix bulk materials.

SUMMARY OF THE INVENTION

In order to achieve the aforementioned object, an agitating and mixing device in an aspect of the present invention comprises: a rotary shaft 6 to be rotated by a driving means 3; a container outer shell 7 fixed to the rotary shaft to tilt relative to the rotary shaft; and an inner shell 9 fixed inside the container outer shell, wherein bulk materials are put into a receiving space 13 formed between the container outer shell and the inner shell and are then agitated and mixed.

An agitating and mixing device in a further aspect of the invention comprises: a rotary shaft 6 to be rotated by a driving means; an inner shell 9 fixed to the rotary shaft to tilt relative to the rotary shaft; a container outer shell 7 fixed around the inner shell; an automatic feed/discharge unit 33 for bulk materials which is mounted to the container outer shell via a rotary joint 35; a screw blade 42 formed on said rotary shaft inside the automatic feed/discharge unit, wherein the bulk materials are put into a receiving space formed between the container outer shell and the inner shell by normal or reverse rotation of said rotary shaft, are then agitated and mixed, and after that are discharged by reverse or normal rotation of said rotary shaft.

An agitating and mixing device in a further aspect of the invention comprises: a driving gear 56, to be rotated by a driving means, and a plurality of supporting gears 55; a pair of rotary rings 53, 54 supported by said gears, a container outer shell 7 fixed to the rotary rings to tilt relative to the rotary rings; and an inner shell 9 fixed inside the container outer shell, wherein bulk materials are put into a receiving space formed between the container outer shell and the inner shell and are then agitated and mixed.

An agitating and mixing device in a further aspect of the invention comprises: a pair of rotary shaft halves 6*a*, 6*b* to be rotated by a driving means; a plurality of container outer shells 7A–7E fixedly disposed between the rotary shaft halves via partition plates 57; inner shells 9 fixed inside the container outer shells, respectively; openings 59 formed in said partition plates, respectively; and flap doors 61 arranged on said openings, respectively, wherein two container outer shells 7A and 7E positioned at both ends are fixed to the rotary shaft halves 6*a*, 6*b* to tilt relative to the rotary shaft halves 6*a*, 6*b*, respectively and the middle container outer shells 7B–7D are arranged to form V-like shapes as seen in the front view, and wherein bulk materials are conveyed successively into and through receiving spaces formed between the container outer shells and the inner shells, whereby the bulk materials agitated and mixed.

An agitating and mixing device in a further aspect of the invention, in combination with any of the embodiments above, being characterized in that said container outer shell(s) and said inner shell(s) are polygonal.

An agitating and mixing device in a further aspect of the invention, in combination with any of the embodiments above, being characterized by further including heat exchangers 26, 27 into which steam or chilled water is supplied and which are attached to the outer surface(s) of said container outer shell(s) and/or the inner surface(s) of said inner shell(s).

An agitating and mixing device in a further aspect of the invention, in combination with any of the embodiments above, being characterized by further including a plurality of agitating blades 49 disposed between said container outer shell(s) and said inner shell(s).

An agitating and mixing device in a further aspect of the invention, in combination with any of the embodiments above, being characterized by further including partition walls 43, 44 disposed between said container outer shell(s) and said inner shell(s) and a plurality of agitating blades disposed between the partition walls. It should be noted that the numerals attached to the aforementioned components are intended to be referred with the attached drawings just for providing an easier understanding of the present invention and do not limit the present invention at all.

An agitating and mixing device in a further aspect of the invention comprises a rotary shaft to be rotated by a driving means; a container outer shell fixed to the rotary shaft to tilt relative to the rotary shaft; and an inner shell disposed inside the container outer shell, wherein bulk materials are put into a receiving space formed between the container outer shell and the inner shell and are then agitated and mixed by rotating said container outer shell and said inner shell in directions opposite to each other.

BRIEF DESCRIPTION OF THE DRAWINGS

FIG. 1(A) is a front view thereof and FIG. 1(B) is a schematic sectional view taken along a line B—B in FIG. 1(A);

FIGS. 4(A), 4(B) show a variation of the embodiment of FIG. 1 wherein FIG. 4(A) is a schematic sectional view thereof and FIG. 4(B) is a side view showing stirring plates shown in FIG. 4(A);

FIGS. 5(A)–5(C) show a variation of the embodiment of FIG. 1 wherein FIG. 5(A) is a schematic sectional view thereof, FIG. 5(B) is a plan view showing stirring plates shown in FIG. 5(A), and FIG. 5(C) is a side view showing the same;

FIGS. 7(A), 7(B) show another variation of the embodiment of FIG. 1, wherein FIG. 7(A) is a schematic sectional view thereof and FIG. 7(B) is a side view showing projections of FIG. 7(A);

FIGS. 10(A), 10(B) show another embodiment of the agitating and mixing device of the present invention, wherein FIG. 10(A) is a front view thereof and FIG. 10(B) is a schematic sectional view taken along a line B—B in FIG. 10(A);

FIGS. 11(A), 11(B) show another embodiment of the agitating and mixing device of the present invention, wherein FIG. 11(A) is a front view thereof and FIG. 11(B) is a schematic sectional view taken along a line B—B in FIG. 11(A);

FIGS. 18(A), 18(B) show yet another embodiment of the agitating and mixing device of the present invention, wherein FIG. 18(A) is a front view thereof and FIG. 18(B) is a view as seen in a direction of arrow B of FIG. 18(A);

FIGS. 19(A), 19(B) show a variation of the embodiment of FIGS. 18(A), 18(B), wherein FIG. 19(A) is a front view thereof and FIG. 19(B) is a view as seen in a direction of arrow B of FIG. 19(A);

FIGS. 20(A), 20(B) show another embodiment of the agitating and mixing device of the present invention, wherein FIG. 20(A) is a front view thereof, and FIG. 20(B) is a partially enlarged sectional view of FIG. 20(A);

DESCRIPTION OF THE PREFERRED EMBODIMENTS

Figure 1:
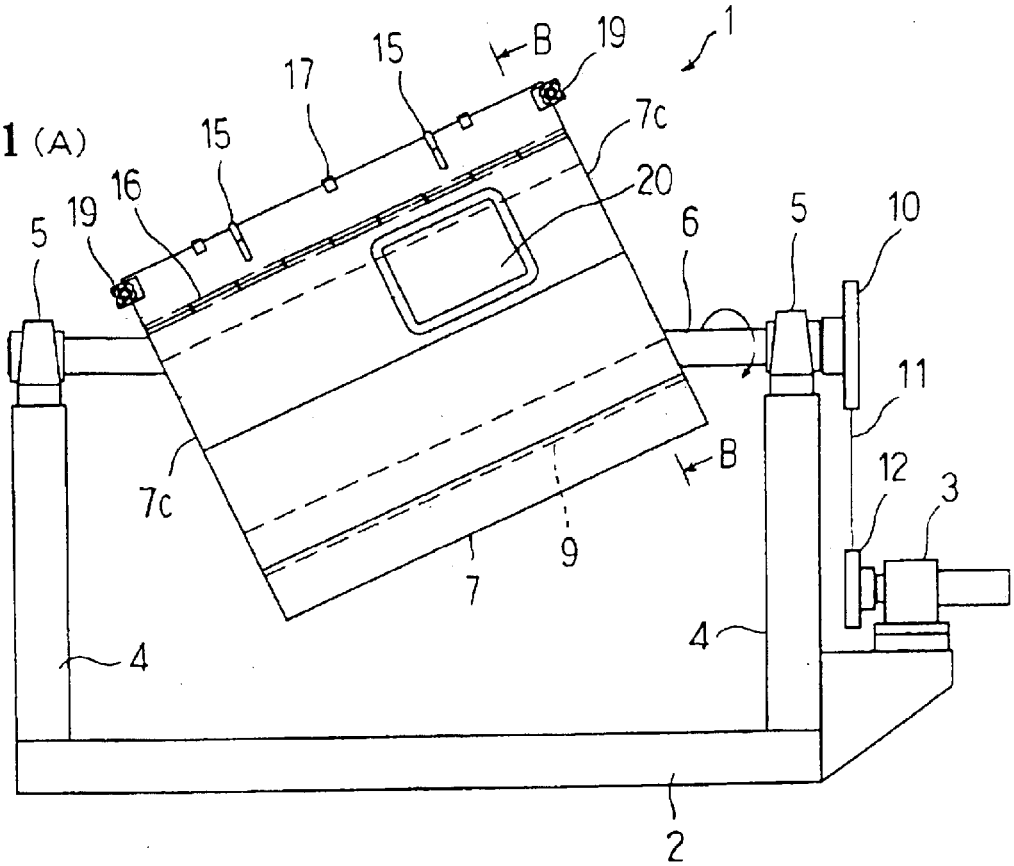
FIGS. 1(A), 1(B) show an embodiment of the agitating and mixing device of the present invention.
Figure 1:
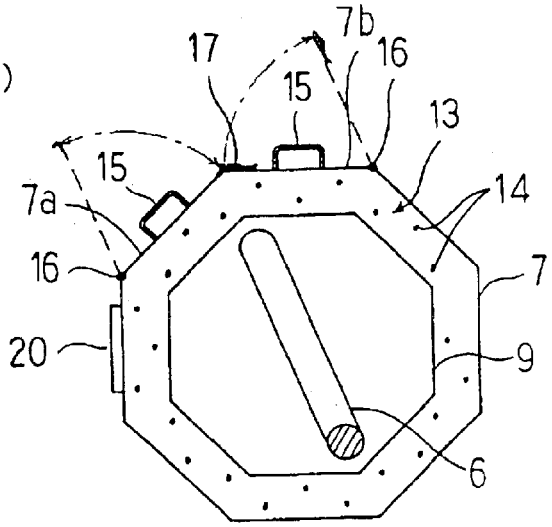
Figure 2A:
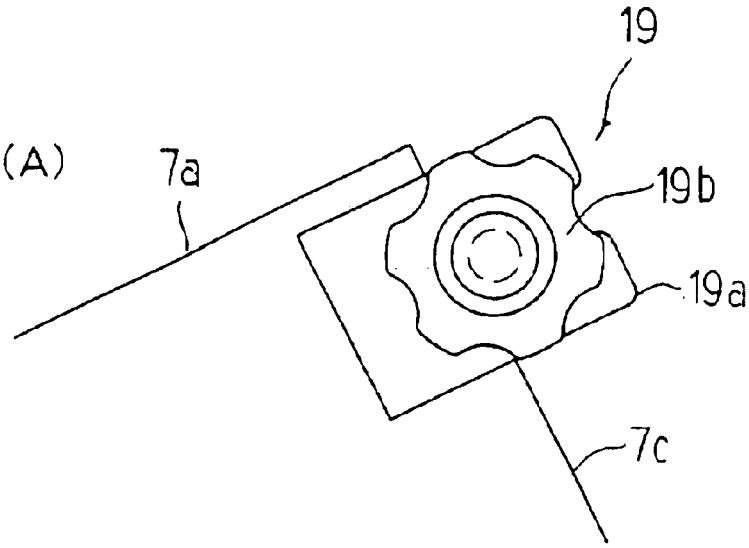
FIGS. 2(A) and 2(B) are enlarged views showing main parts of FIG. 1(A)
Figure 2B:
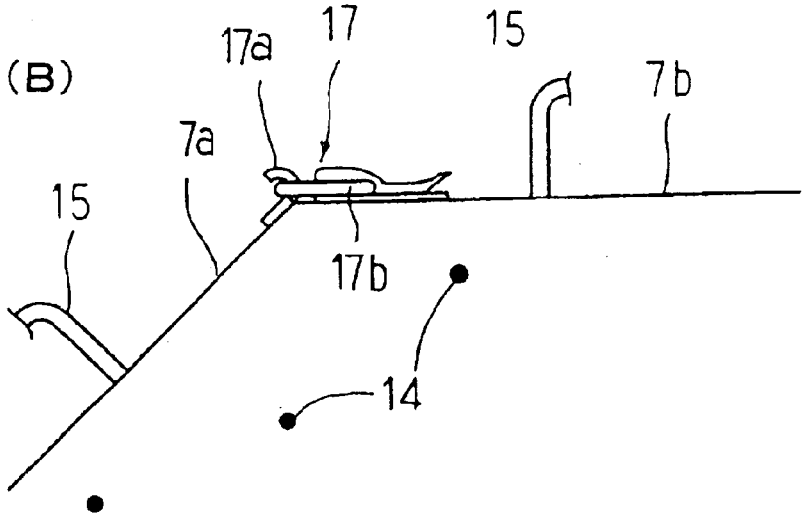

Hereinafter, embodiments of the present invention will be described with reference to the attached drawings. FIGS. 1(A) through 3(C) show an embodiment of the agitating and mixing device of the present invention, FIG. 1(A) is a front view thereof, FIG. 1(B) is a schematic sectional view taken along a line B—B in FIG. 1(A), FIGS. 2(A) and 2(B) are enlarged views showing main parts of FIG. 1(A), and FIGS. 3(A)–3(C) are illustrations for explaining works of the present invention.

As shown in FIG. 1(A), the agitating and mixing device 1 of this embodiment comprises a frame 2, an adjustable speed motor (driving means) 3 attached to the frame 2, a pair of supports 4, 4 standing on the frame 2, a rotary shaft 6 rotatably supported by bearings 5 on the supports 4, a polygonal container outer shell 7 secured to the rotary shaft 6, a polygonal inner shell 9 which is analogously fixed inside the container outer shell 7, a driven sprocket (or pulley) 10 connected to one end of the rotary shaft 6, and a driving sprocket (or pulley) 12 coupled to the driven sprocket 10 via a chain (or belt) 11. The driving sprocket 12 is connected to the adjustable speed motor 3. The rotary shaft 6 extends through the container outer shell 7 in the horizontal direction. The container outer shell 7 is arranged such that its axis tilts relative to the rotary shaft 6 and side plates 7*c* of the container outer shell 7 are secured to the rotary shaft 6.

Formed between the container outer shell 7 and the inner shell 9 is a receiving space 13 for receiving bulk materials to be agitated and mixed. Inside the receiving space 13, a plurality of wires 14 are arranged to extend between the right and left side plates 7*c* as necessary. Among the shell plates composing the polygon of the container outer shell 7, two adjacent shell plates are biparting lids 7*a*, 7*b* which are provided with handles 15 and of which one sides are hinged by hinges 16 so that the biparting lids 7*a*, 7*b* can freely pivot. As shown in FIG. 2(B), the other sides of the biparting lids 7*a*, 7*b* can be latched to each other by latching means 17 comprising a hook 17*a* and a latch 17*b*. As shown in FIG. 2(A), stopper plates 19*a* are fixed to both side edges of the biparting lids 7*a*, 7*b* and clamping handles 19*b* are rotatably disposed to the side plates 7*c* of the container outer shell 7. The stopper plates 19*a* and the clamping handles 19*b* compose clamping means 19. The biparting lids 7*a*, 7*b* and side plates 7*c* can be tightly closed by the clamping means 19. The container outer shell 7 has a sight glass 20 formed at arbitrary locations for observing the condition of agitation and mixing.

Hereinafter, works of the agitating and mixing device having the aforementioned structure will be described. After releasing the latch and clamping of the latching means 17 and the clamping means 19, the biparting lids 7*a*, 7*b* are opened by operating the handles 15 as shown by dotted lines of FIG. 1(B) to put bulk materials into receiving space 13 and, after that, the biparting lids 7*a*, 7*b* are closed. Then, the adjustable speed motor 3 is driven and the speed of rotation is adjusted suitably for agitating and mixing the bulk materials to rotate the rotary shaft 6. Therefore, the container outer shell 7 is rotated. When the agitation and mixing is finished, the motor 3 is stopped at a position where the biparting lids 7*a*, 7*b* face downward. The biparting lids 7*a*, 7*b* are opened to discharge the agitated and mixed bulk materials. To agitate and mix another bulk materials after discharging the agitated and mixed bulk materials, the motor is driven after closing the biparting lids 7*a*, 7*b* and is stopped at a position where the biparting lids 7*a*, 7*b* face upward. After that, the aforementioned processes are repeated.

Figure 3A:
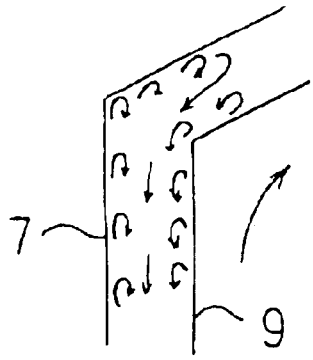
FIGS. 3(A)–3(C) are illustrations for explaining works of the present invention.
Figure 3B:
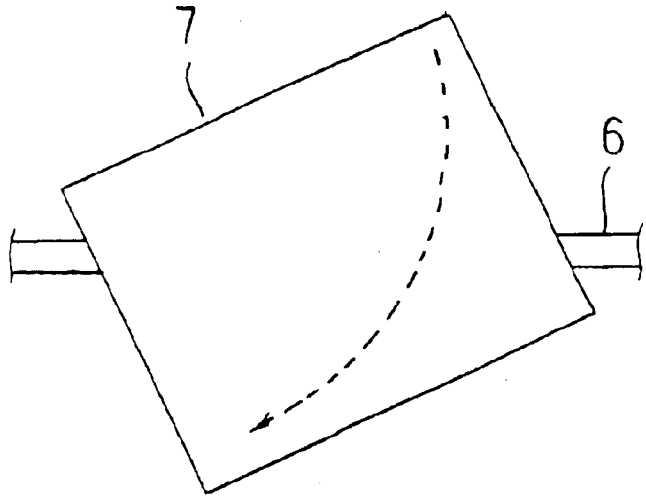
Figure 3C:
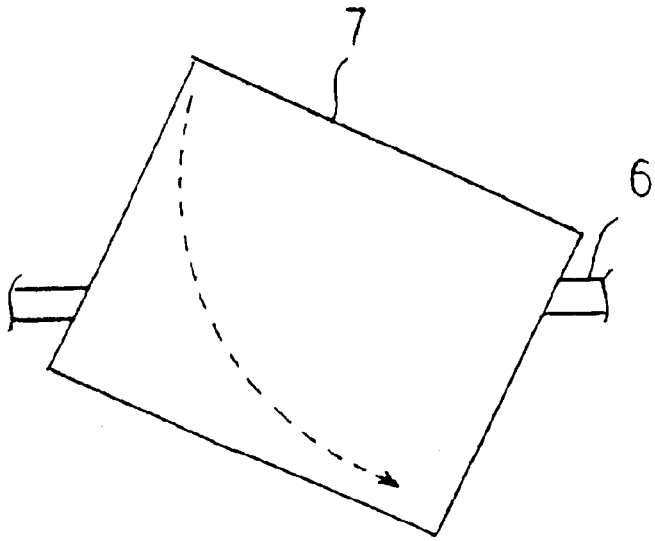

According to the present invention, since the container outer shell 7 and the inner shell 9 are polygonal, bulk materials caught by corners fall down so as to generate turbulence of the bulk materials by the rotation of the container outer shell 7 in a direction of arrow as shown in FIG. 3(A), thereby uniformly agitating and mixing the bulk materials. In addition, since the container outer shell 7 is arranged such that its axis tilts relative to the rotary shaft 6, every rotation of the rotary shaft 6 by 180° reverses the tilting direction of the container outer shell 7 from right to left or from left to right as shown in FIGS. 3(B) and 3(C). As a result, the bulk materials move in the receiving space 13 like waves as shown by dotted lines so that bulk materials in an upper layer flow below the bulk materials in an under layer at the opposite side, thereby uniformly agitating and mixing the bulk materials.

In case of mixing bulk materials which are easily caked by agitation, wires 14 are arranged inside the receiving space 13 so that caked bulk materials are hit and broken by the wires 14.

Figure 4A:
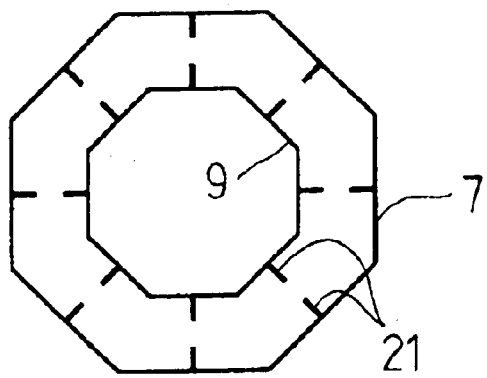
Figure 4B:
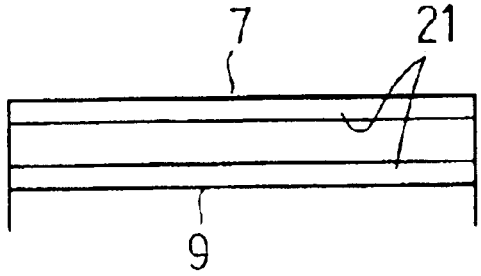

FIGS. 4(A), 4(B) show a variation of the embodiment of FIG. 1 wherein FIG. 4(A) is a schematic sectional view thereof and FIG. 4(B) is a side view showing stirring plates shown in FIG. 4(A). In this variation, plate-like stirring plates 21 are disposed on the respective inner surfaces of the shell plates of the container outer shell 7 and the respective outer surfaces of the shell plates of the inner shell 9 to extend over their entire length, thereby further uniformly mixing bulk materials. The stirring plates 21 may be disposed on either the container outer shell 7 or the inner shell 9 and may be disposed at corners of polygon of the container outer shell 7 and/or inner shell 9.

Figure 5A:
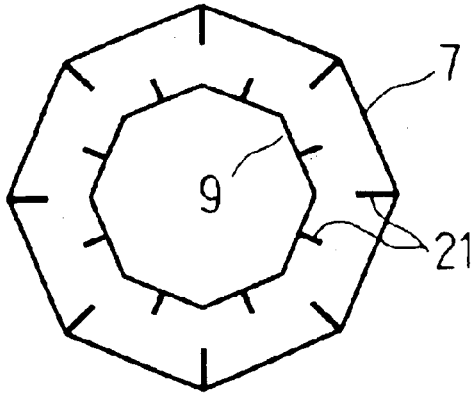
Figure 5B:
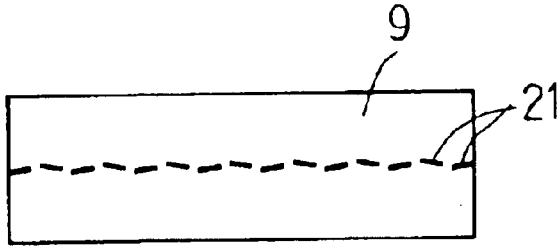
Figure 5C:
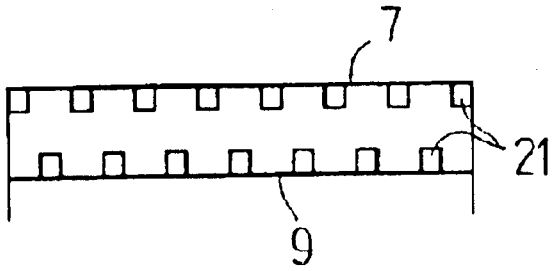

FIGS. 5(A)–5(C) show a variation of the embodiment of FIG. 1 wherein FIG. 5(A) is a schematic sectional view thereof, FIG. 5(B) is a plan view showing stirring plates shown in FIG. 5(A), and FIG. 5(C) is a side view showing the same. In this variation, a large number of stirring plates 21 having small widths are disposed at the respective corners of the inner surface of the container outer shell 7 and on the respective outer surfaces of the shell plates of the inner shell 9. The stirring plates 21 are alternatively arranged to tilt as shown in FIG. 5(B). In addition, the stirring plates 21 on the container outer shell 7 and the stirring plates 21 on the inner shell 9 are arranged in a zigzag pattern as shown in FIG. 5(C). The stirring plates 21 may be disposed on either the container outer shell 7 or the inner shell 9.

Figure 6:
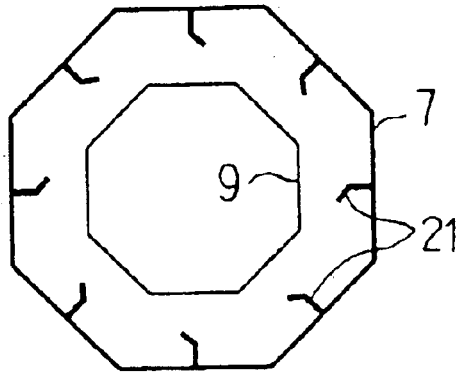
FIG. 6 is a schematic sectional view showing a variation of the embodiment of FIG. 1.

FIG. 6 is a schematic sectional view showing a variation of the embodiment of FIG. 1. In this variation, stirring plates 21 each having a shovel-like end are disposed on the respective inner surface of the shell plates of the container outer shell 7. Because of this configuration of the stirring plates 21, bulk materials can be stirred upward, thereby further uniformly mixing the bulk materials. The stirring plates 21 may be disposed on the inner shell 9 or both the container outer shell 7 and the inner shell 9.

Figure 7A:
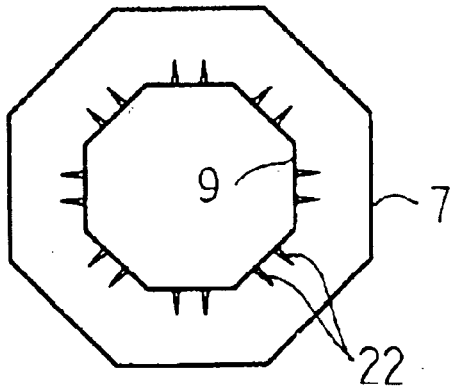
Figure 7B:
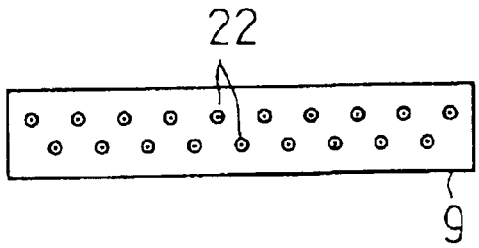

FIGS. 7(A), 7(B) show another variation of the embodiment of FIG. 1, wherein FIG. 7(A) is a schematic sectional view thereof and FIG. 7(B) is a side view showing projections of FIG. 7(A). In this embodiment, a large number of projections 22 are disposed on the respective outer surfaces of the shell plates of the inner shell 9 so that caked bulk materials are hit and broken by the projections 22. The projections 22 may be disposed on the container outer shell 7 or both the container outer shell 7 and the inner shell 9.

Figure 8A:
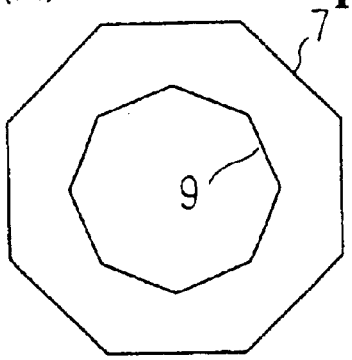
FIGS. 8(A)–8(D) are schematic sectional views showing variations of the embodiment of FIG. 1.
Figure 8B:
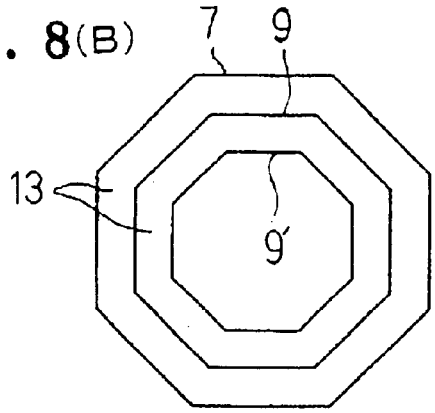
Figure 8C:
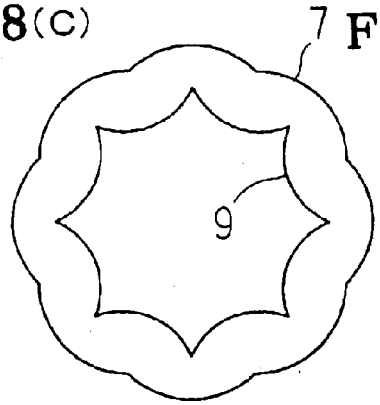
Figure 8D:
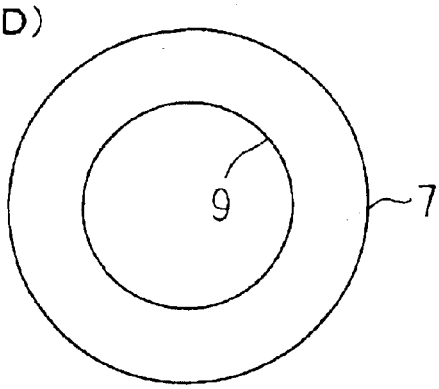

FIGS. 8(A)–8(D) show variations of the embodiment of FIG. 1, wherein FIG. 8(A) shows a variation in which the container outer shell 7 and the inner shell 9 are arranged such that the corners of the container outer shell 7 do not coincide with the corners of the inner shell 9, FIG. 8(B) shows a variation further comprising another inner shell 9' disposed inside the inner shell 9 to form two receiving spaces 13, FIG. 8(C) is a variation in which the respective shell plates composing polygons of the container outer shell 7 and the inner shell 9 have curved surfaces (convex or concave surfaces), and FIG. 8(D) shows a variation in which the container outer shell 7 and the inner shell 9 are cylindrical.

Figure 9A:
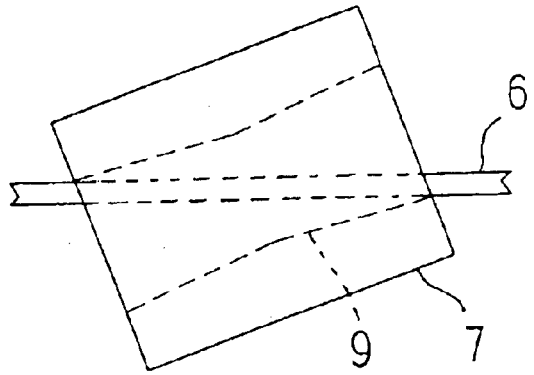
FIGS. 9(A)–9(D) are schematic sectional views showing variations of the embodiment of FIG. 1.
Figure 9B:
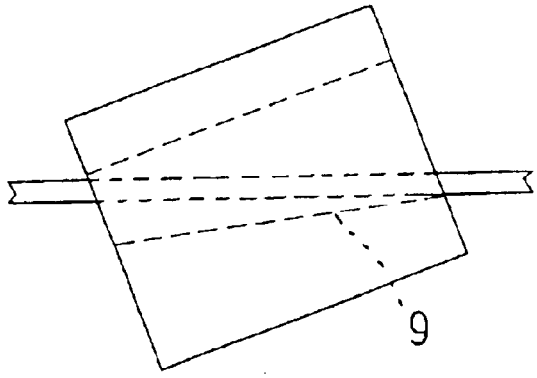
Figure 9C:
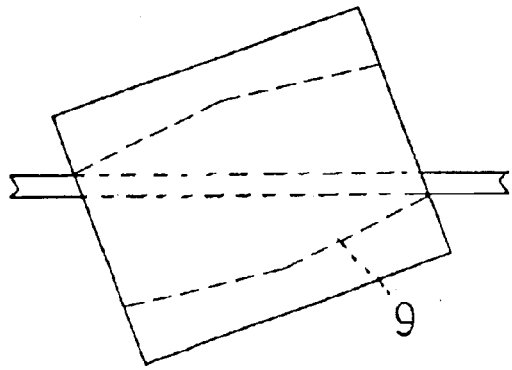
Figure 9D:
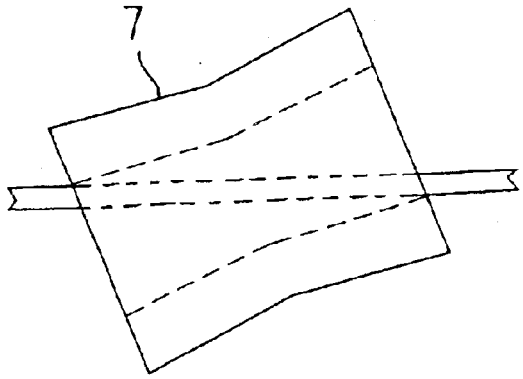

FIGS. 9(A)–9(D) show variations of the embodiment of FIG. 1, wherein FIG. 9(A) shows a variation in which the inner shell 9 is formed to have a throttling middle portion, FIG. 9(B) shows a variation in which the inner shell 9 is formed to have an inclined portion at one side, FIG. 9(C) shows a variation in which the inner shell 9 is formed to have a bulged middle portion, and FIG. 9(D) shows a variation in which the container outer shell 7 is also formed to have a throttling middle portion in addition to the variation of FIG. 9(A).

Figure 10A:
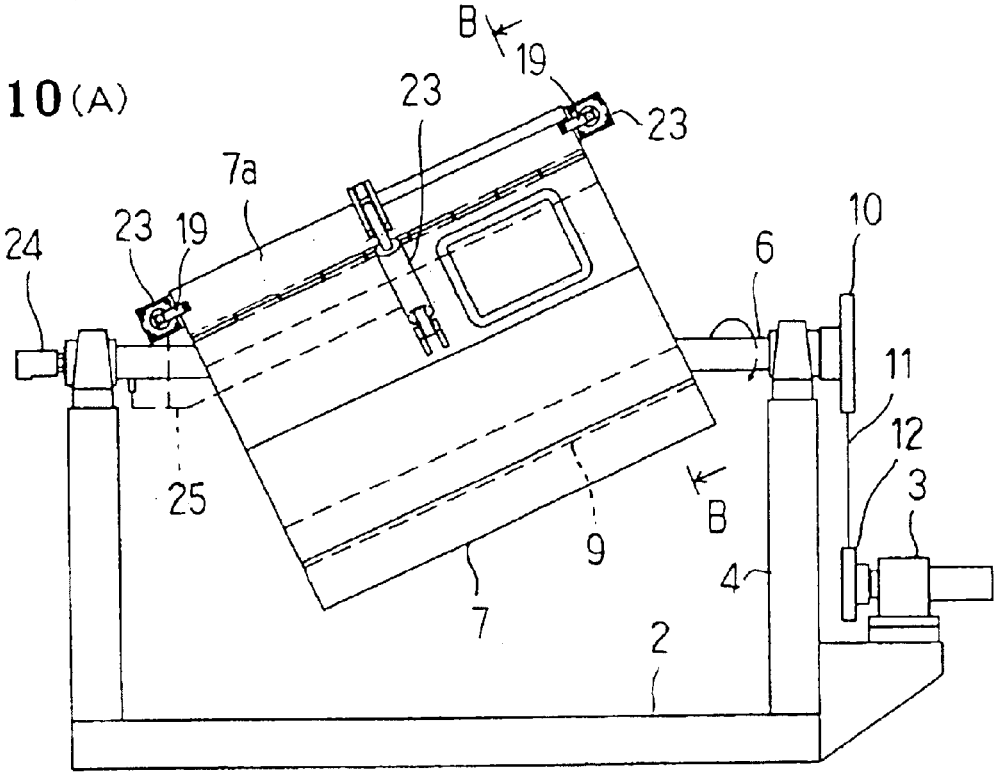
Figure 10B:
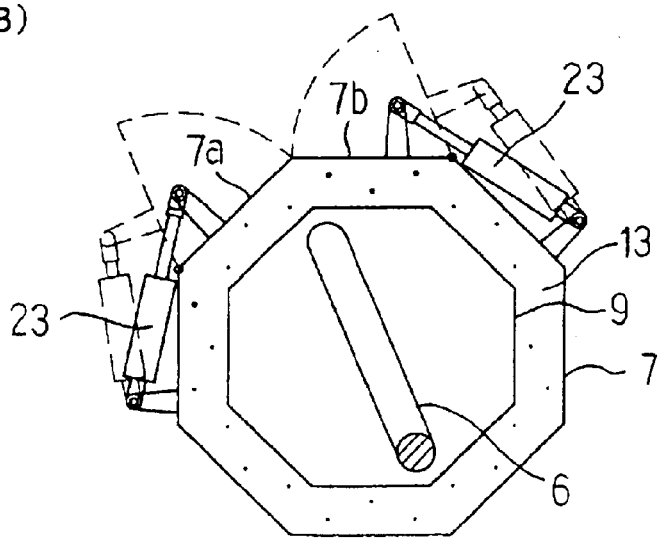
Figure 11A:
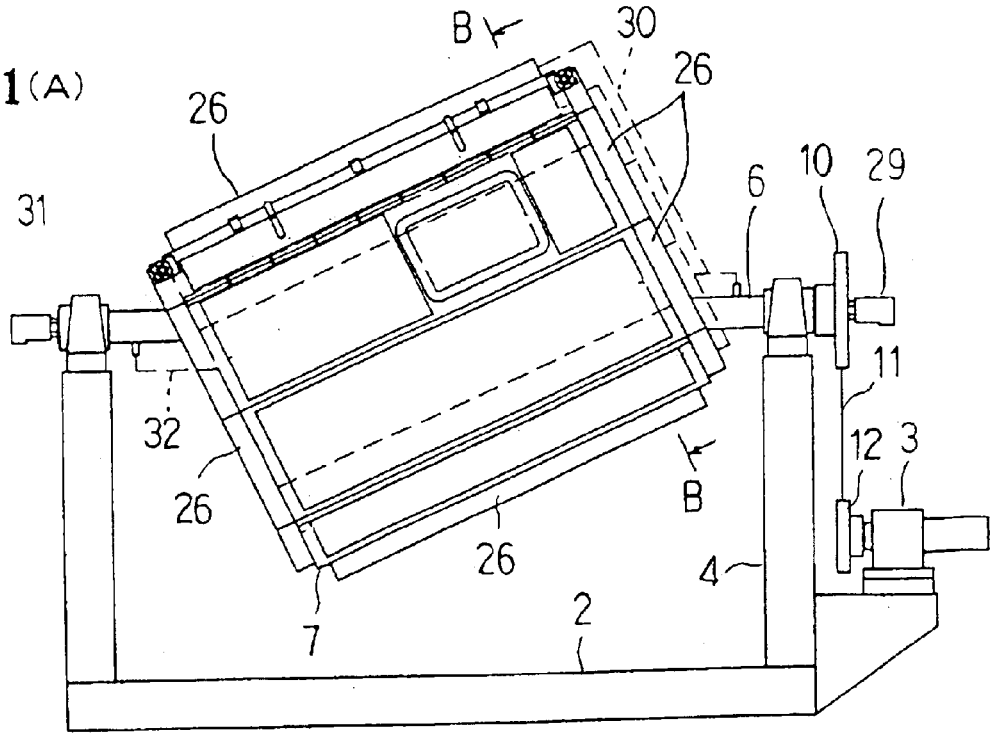
Figure 11B:
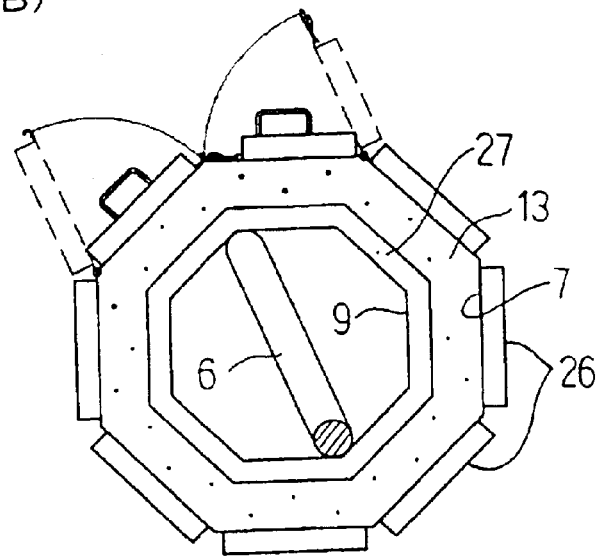

FIGS. 10(A), 10(B) and FIGS. 11(A), 11(B) show another embodiments of the agitating and mixing device of the present invention, wherein FIGS. 10(A), 11(A) are front views thereof and FIGS. 10(B), 11(B) are schematic sectional views taken along a line B—B in FIGS. 10(A), 11(A), respectively. In the following embodiments, corresponding component parts are designated with the same reference numerals utilized in the aforementioned embodiment, thus omitting the detail description of such component parts.

In the embodiment of FIGS. 10(A), 10(B), the biparting lids *7a*, *7b* and clamping means 19 are driven by air cylinders 23. Air is supplied to the air cylinders 23 through an air-supply joint 24, an air passage in the rotary shaft 6, and pipes 25.

In the embodiment of FIGS. 11(A), 11(B), the agitating and mixing device is further provided with a drying function or a cooling function. The container outer shell 7 is provided on its outer surface with a plurality of heat exchangers 26 and the inner shell 9 is also provided on its inner surface with a heat exchanger 27. A steam or chilled water supply joint 29 is connected to one end of the rotary shaft 6 so that steam or chilled water is supplied to the heat exchangers 26, 27 through a passage in the rotary shaft 6 and pipes 30. Connected to the other end of the rotary shaft 6 is a moisture suction joint 31, whereby moisture within the receiving space 13 is discharged through a pipe 32.

Figure 12:
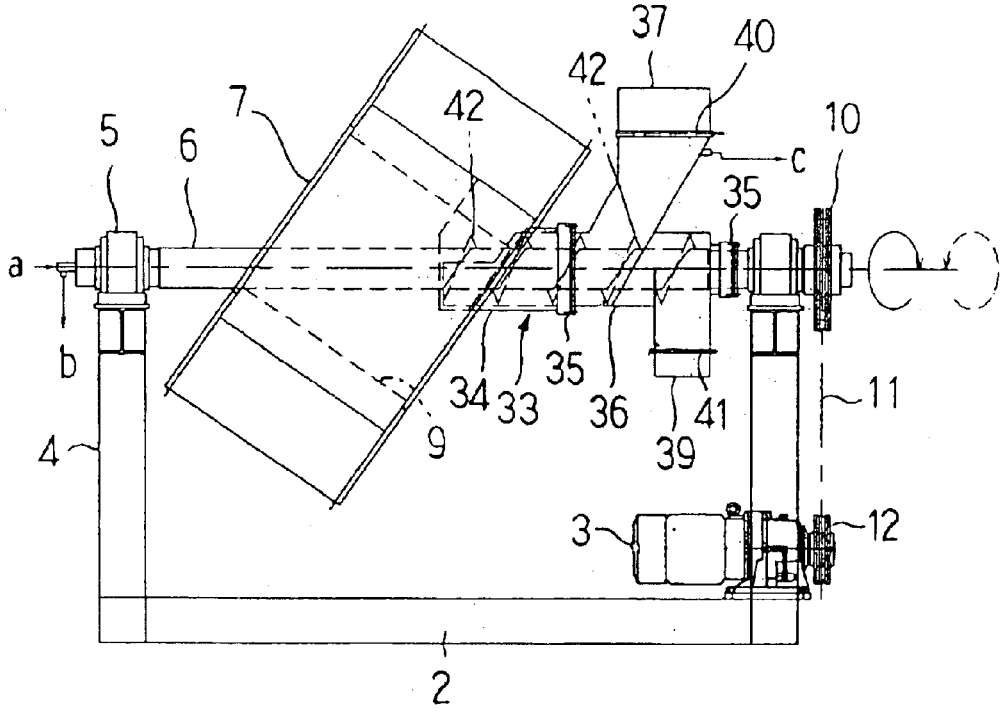
FIG. 12 is a front view showing further another embodiment of the agitating and mixing device of the present invention.

FIG. 12 is a front view showing further another embodiment of the agitating and mixing device of the present invention. In this embodiment, the container outer shell 7 is provided with an automatic feed/discharge unit 33 for automatically supplying and discharging bulk materials. The automatic feed/discharge unit 33 comprises a rotary shaft 6 attached to the inner shell 9 to extend through the container outer shell 7, a rotary tube 34 fixed to the container outer shell 7, and a stationary tube 36 connected to the rotary tube 34 and the rotary shaft 6 through rotary joints 35, 35. Provided above the stationary tube 36 is a feed hopper 37 and provided below the stationary tube 36 is a discharge hopper 39. The feed hopper 37 and the discharge hopper 39 are provided with shut-off dampers 40, 41, respectively. The rotary shaft 6 is provided with a screw blade 42 arranged along the rotary tube 34 and the stationary tube 36. The driving means 3 is composed of a motor capable of switching between the normal rotation and reverse rotation. Mark "a" designates a heating steam inlet and "b" designates a heating steam outlet, and "c" designates a vacuum pump connection port for reducing the pressure in the container outer shell 7.

Hereinafter, works of this embodiment will be described. The shut-off damper 40 is opened and bulk materials are supplied from the feed hopper 37. As the rotary shaft 6 is rotated in the direction indicated by a solid-line arrow in FIG. 12, the bulk materials are supplied into a space between the container outer shell 7 and the inner shell 9 by the screw blade 42. As a predetermined amount of bulk materials are conveyed into the container outer shell 7, the shut-off damper 40 is closed and the bulk materials are agitated and mixed. When the agitation and mixing is finished, the rotary shaft 6 is reversely rotated in the direction indicated by a dotted-line arrow in FIG. 12 so that the bulk materials are conveyed to the discharge hopper 39 by the screw blade 42. The shut-off damper 41 is opened to discharge the agitated and mixed bulk materials out of the device.

Figure 13:
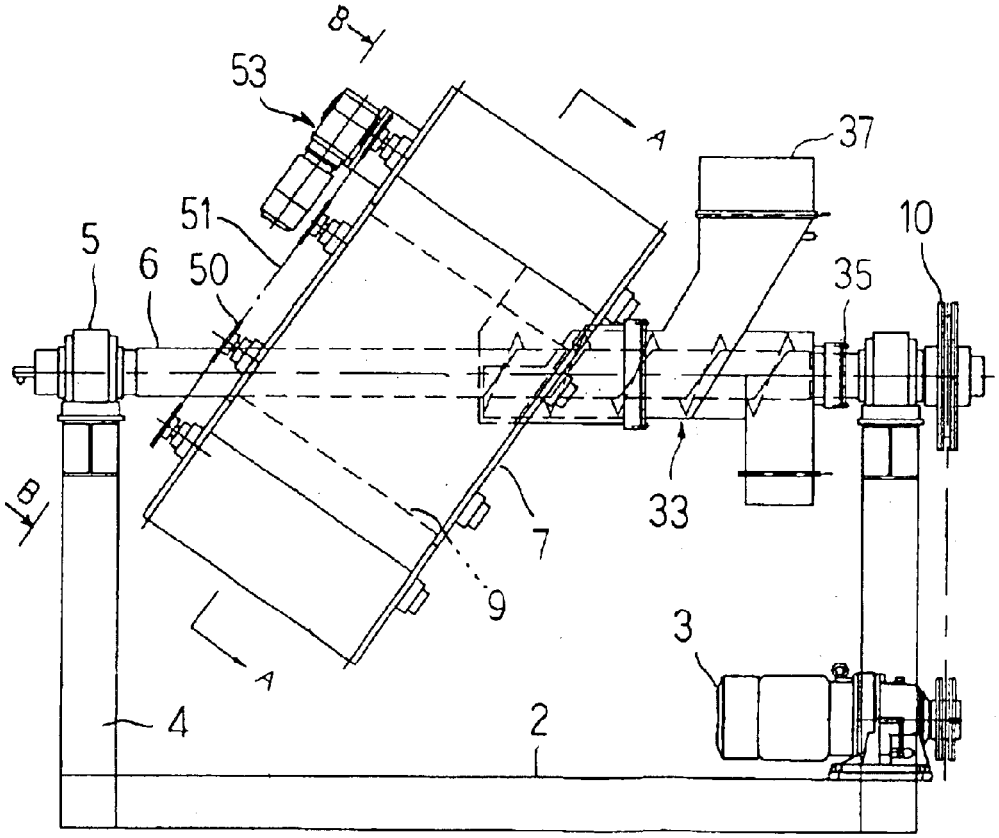
FIG. 13 is a front view showing further another embodiment of the agitating and mixing device of the present invention.
Figure 14A:
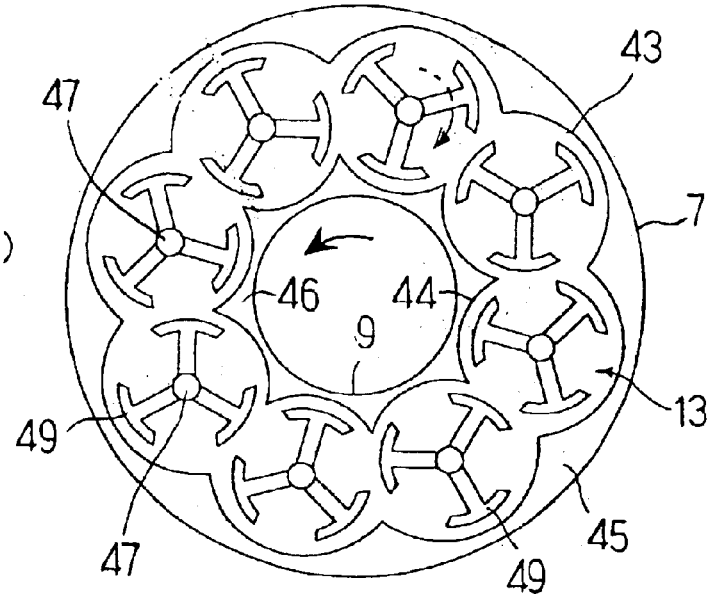
FIG. 14(A) is a sectional view taken along a line A—A of FIG. 13.
Figure 14B:
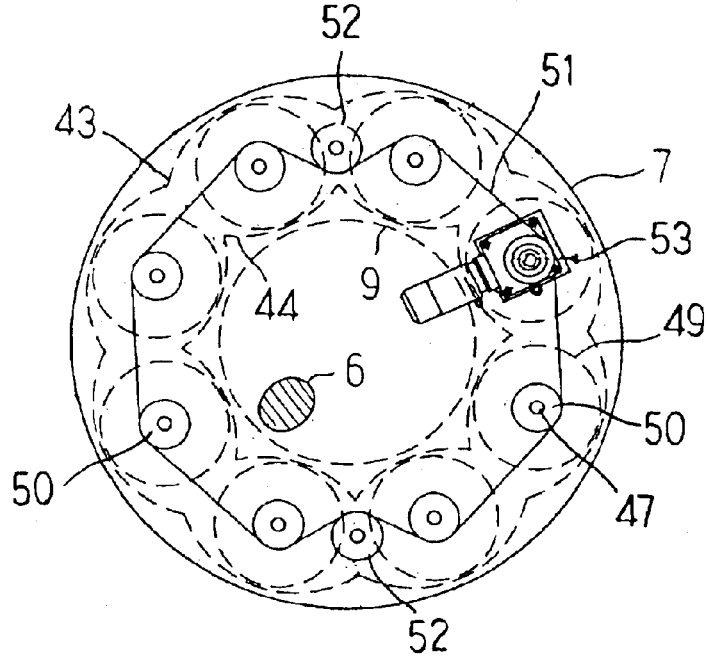
FIG. 14(B) is a view taken along a line B—B of FIG. 13.
Figure 14C:
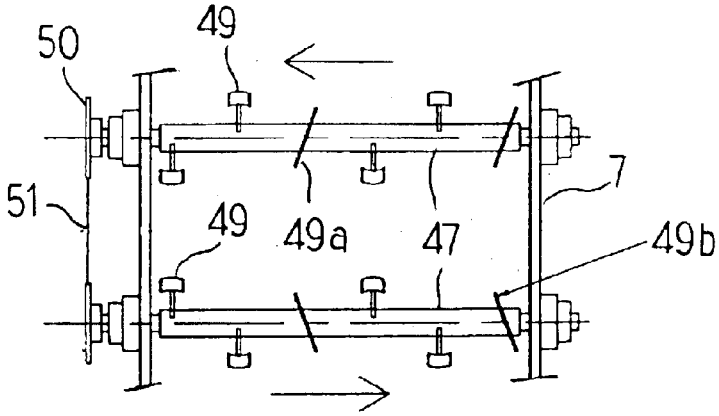
FIG. 14(C) is a partial sectional view of FIG. 14(C)

FIGS. 13–14(C) show still another embodiment of the agitating and mixing device of the present invention, wherein FIG. 13 is a front view thereof, FIG. 14(A) is a sectional view taken along a line A—A of FIG. 13, FIG. 14(B) is a view taken along a line B—B of FIG. 13, and FIG. 14(C) is a partial sectional view of FIG. 13.

In this embodiment, an outside wall 43 and an inside wall 44 (partition walls) which are composed of continuous arc faces are arranged to face each other so that a receiving space 13 is formed between the outside wall 43 and the inside wall 44 and heating steam chambers 45, 46 are formed between the container outer shell 7 and the outside wall 43 and between the inner shell 9 and the inside wall 44, respectively. A plurality of agitating shafts 47 are disposed inside the receiving space 13 and are each provided with a plurality of agitating blades 49. Fixed to one end of each agitating shaft 47 is a pulley 50. A driving belt or chain 51 is wound around the pulleys via tension pulleys 52. A driving motor 53 is connected to one of the pulleys 50. It should be noted that the structure of an automatic feed/discharge unit 33 is the same as that of the embodiment shown in FIG. 12.

Hereinafter, works of this embodiment will be described. The rotary shaft 6 is driven by the motor 3 to rotate the container outer shell 7 as shown by a solid-line arrow in FIG. 14(A). In addition, the driving motor 53 is driven to rotate the agitating shafts 47 as shown by a dotted-line arrow. Accordingly, bulk materials are further uniformly agitated and mixed by agitation of the agitating blades 49 in addition to the agitation by the rotation of the container outer shell 7. As shown in FIG. 14(C), some or all of agitating blades 49*a*, 49*b* on a agitating shaft 47 may be arranged to tilt in an opposite direction of the tilting direction of corresponding ones of the adjacent agitating shaft 47. According to this arrangement, bulk materials are conveyed from right to left and left to right, thereby further uniformly agitating and mixing the bulk materials.

Figure 15:
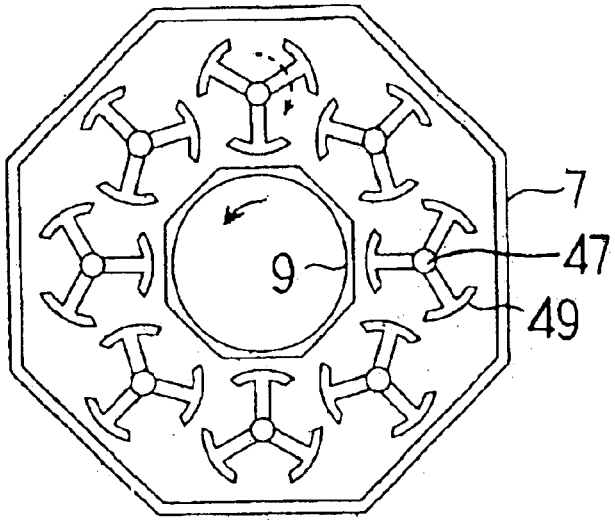
FIG. 15 is a sectional view similar to FIG. 14(A) but showing a variation of the embodiment of FIGS. 14(A)–14(C)

FIG. 15 is a sectional view similar to FIG. 14(A) but showing a variation of the aforementioned embodiment. In this variation, the container outer shell 7 and the inner shell 9 are formed into polygon without partition walls composed of the outside wall 43 and the inside wall 44 as shown in FIG. 14(A) and the agitating blades 49 are disposed between the container outer shell 7 and the inner shell 9.

Figure 16:
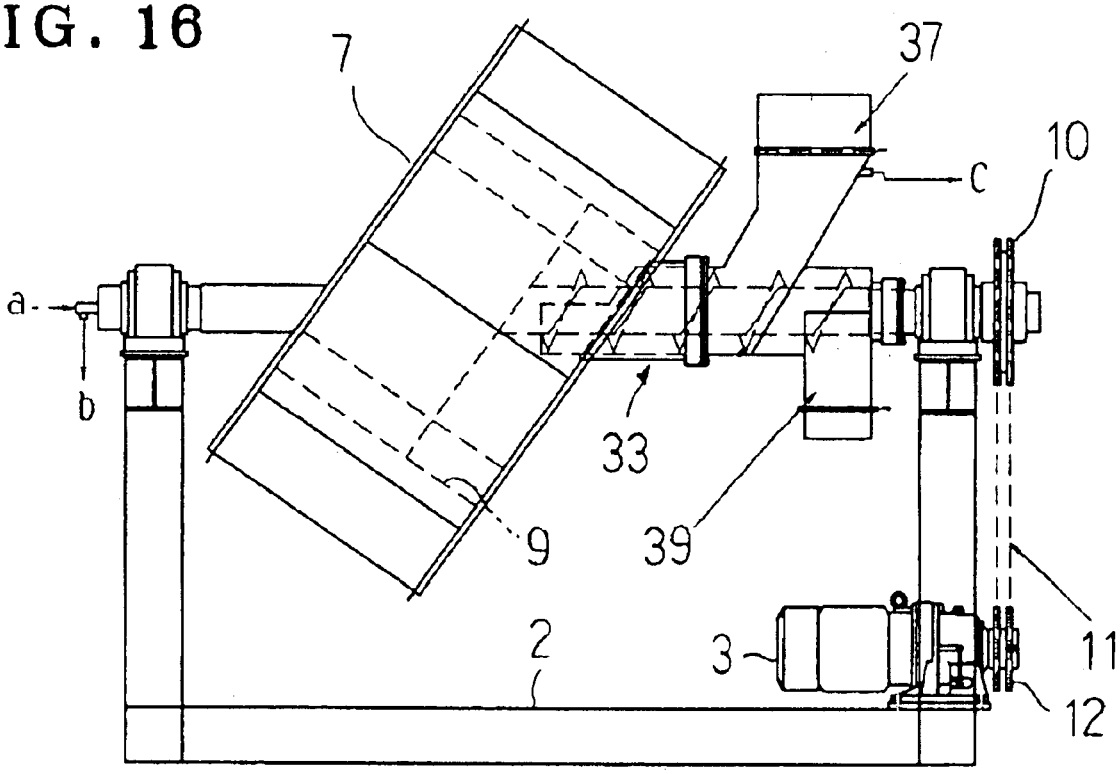
FIG. 16 is a front view showing a variation of the embodiment of FIG. 12.

FIG. 16 is a front view showing a variation of the embodiment of FIG. 12. Though the rotary shaft 6 extends through the container outer shell 7 in the embodiment of FIG. 12, rotary shaft halves 6 secured to the both sides of the container outer shell 7 compose the rotary shaft 6 in this embodiment. This enables the reduction in sectional area of the inner shell 9, thus reducing the size of the device and reducing the power, as for the same capacity. It should be noted that this variation is not limited to be adapted to the embodiment of FIG. 12 and is also be adapted to the other embodiments.

Figure 17:
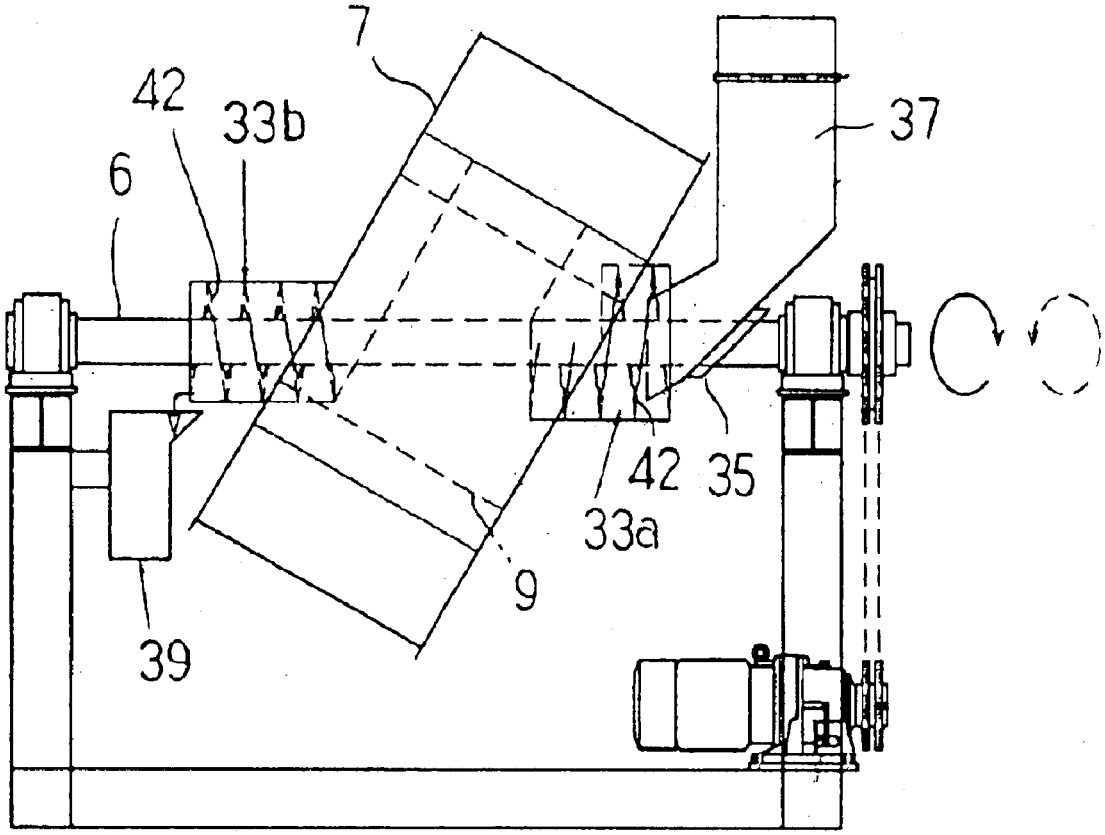
FIG. 17 is a front view showing a variation of the embodiment of FIG. 12.

FIG. 17 is a front view showing a variation of the embodiment of FIG. 12. In this variation, an automatic feed unit 33*a* for supplying bulk materials is arranged on one side of the container outer shell 7 and an automatic discharge unit 33*b* for discharging the bulk materials is arranged on the other side of the container outer shell 7. A discharge hopper 39 is disposed at the outlet of the automatic discharge unit 33*b*. As bulk materials are supplied from a feed hopper 37 and the rotary shaft 6 is rotated in the direction indicated by a solid-line arrow in FIG. 17, bulk materials are supplied into a space between the container outer shell 7 and the inner shell 9 by the screw blade 42. After a predetermined amount of bulk materials are conveyed into the container outer shell 7, the bulk materials are agitated and mixed. When the agitation and mixing is finished, the rotary shaft 6 is reversely rotated in the direction indicated a dotted-line arrow in FIG. 17 so that the bulk materials are conveyed to the discharge hopper 39 by the screw blade 42.

Figure 18A:
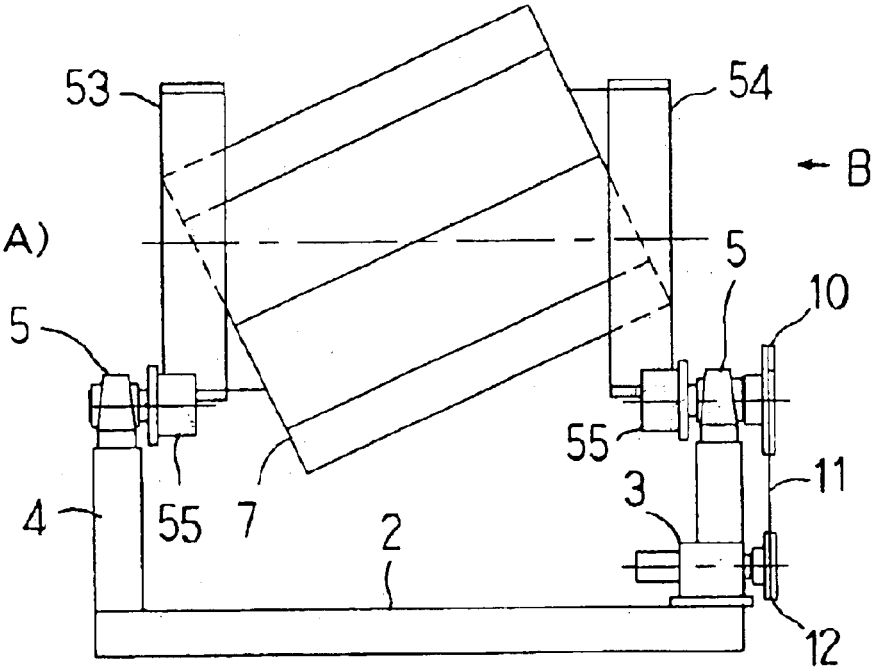
Figure 18B:
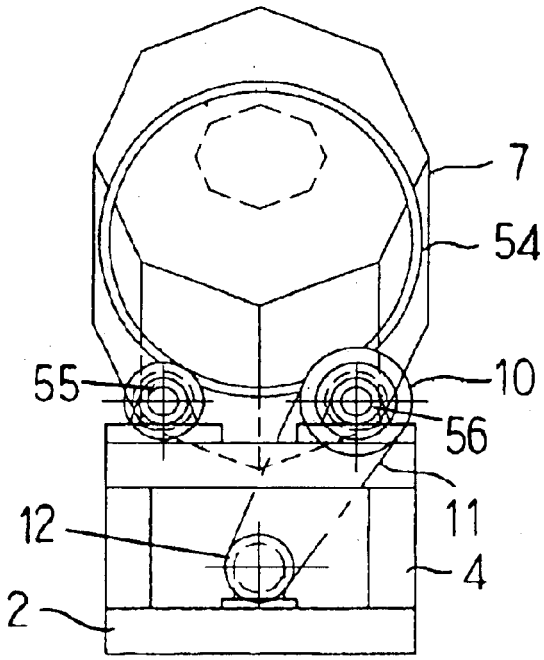

FIGS. 18(A), 18(B) show yet another embodiment of the agitating and mixing device of the present invention, wherein FIG. 18(A) is a front view thereof and FIG. 18(B) is a view as seen in a direction of arrow B of FIG. 18(A). In any of the aforementioned embodiments, the container outer shell 7 is rotated by the rotary shaft 6. In this embodiment, however, rotary rings 53, 54 are employed instead of the rotary shaft 6.

That is, the rotary rings 53, 54 are fixed to the both sides of the tilt container outer shell 7. One of the rotary ring 53 is supported by a supporting roller (or gear) 55 from below and the other rotary ring 54 is supported by a supporting gear 55 and a driving gear 56. The driving gear 56 is meshed with external teeth of the rotary ring 54. The supporting gear 55 and the driving gear 56 are supported to the supports via bearings 5. A driven sprocket 10 is arranged on the other end of the driving gear 56 and is coupled to a driving sprocket (or pulley) 12 via a chain (or a belt) 11.

According to the present invention, the employment of the rotary rings 53, 54 enables the reduction in size of the container outer shell 7, thus reducing the size of the device itself, as for the same capacity, in a comparison of the case that the rotary shaft 6 extends through the container outer shell 7.

Figure 19A:
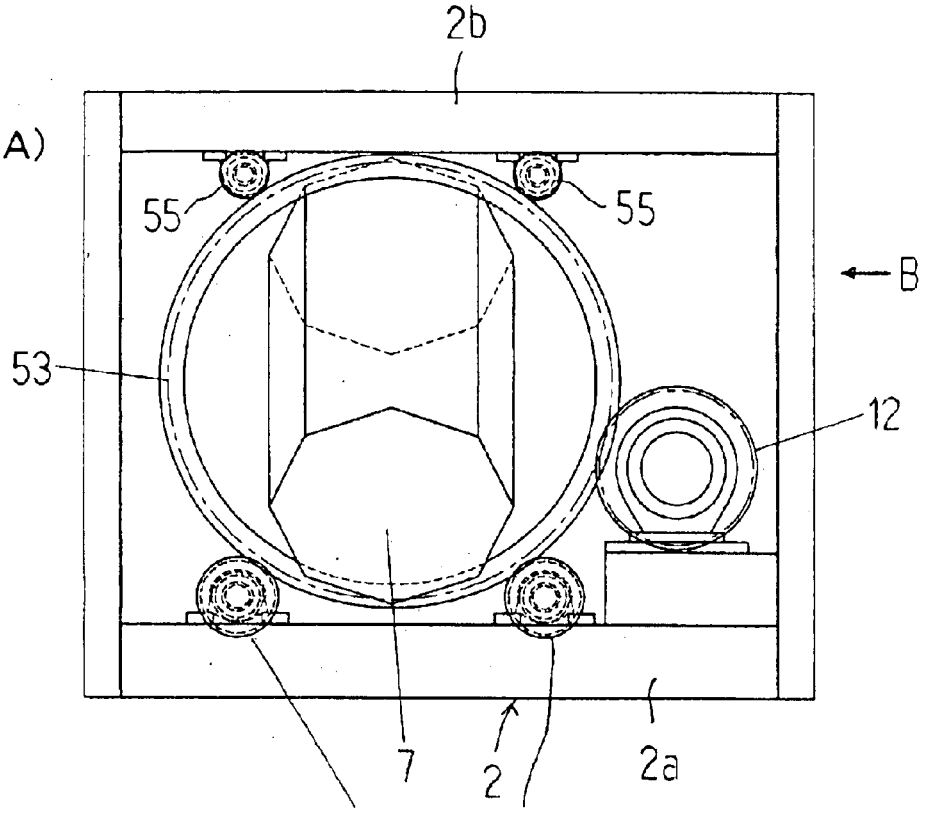
Figure 19B:
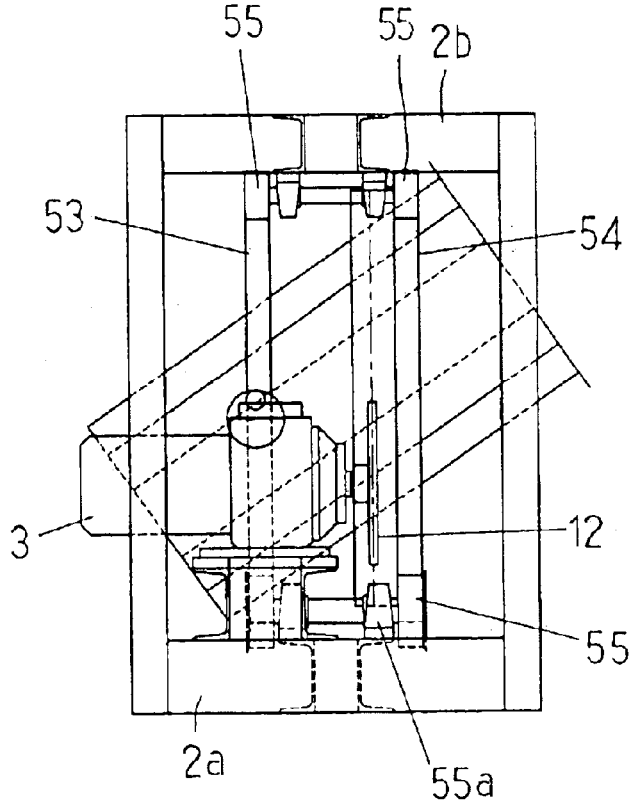

FIGS. 19(A), 19(B) show a variation of the embodiment of FIGS. 18(A), 18(B), wherein FIG. 19(A) is a front view thereof and FIG. 19(B) is a view as seen in a direction of arrow B of FIG. 19(A). Also in this variation, rotary rings 53, 54 are employed instead of the rotary shaft 6 similarly to the embodiment of FIGS. 18(A), 18(B).

In this variation, the frame 2 is formed in a box shape comprising sub frames 2*a*, 2*b*. Four supporting gears (or rollers) 55 are disposed on each of the upper and lower sub frames 2*a*, 2*b* by bearings 55*a*. The tilt container outer shell 7 are supported by two rotary rings 53, 54 meshed with and supported by the supporting gears 55. External teeth of one of the rotary rings 54 are meshed with a driving gear 12 so that the rotary ring 54 is connected to the driving motor 3 through the driving gear 12. According to this variation, the device fits in the sub frames 2*a*, 2*b*, thus further reducing the size of the device.

Figure 20A:
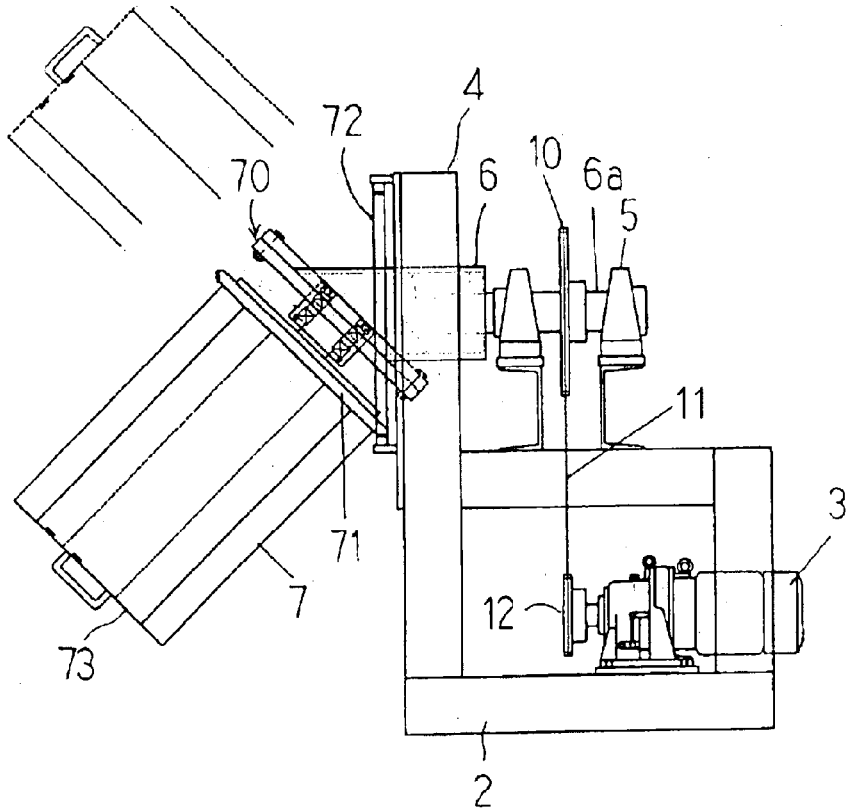
Figure 20B:
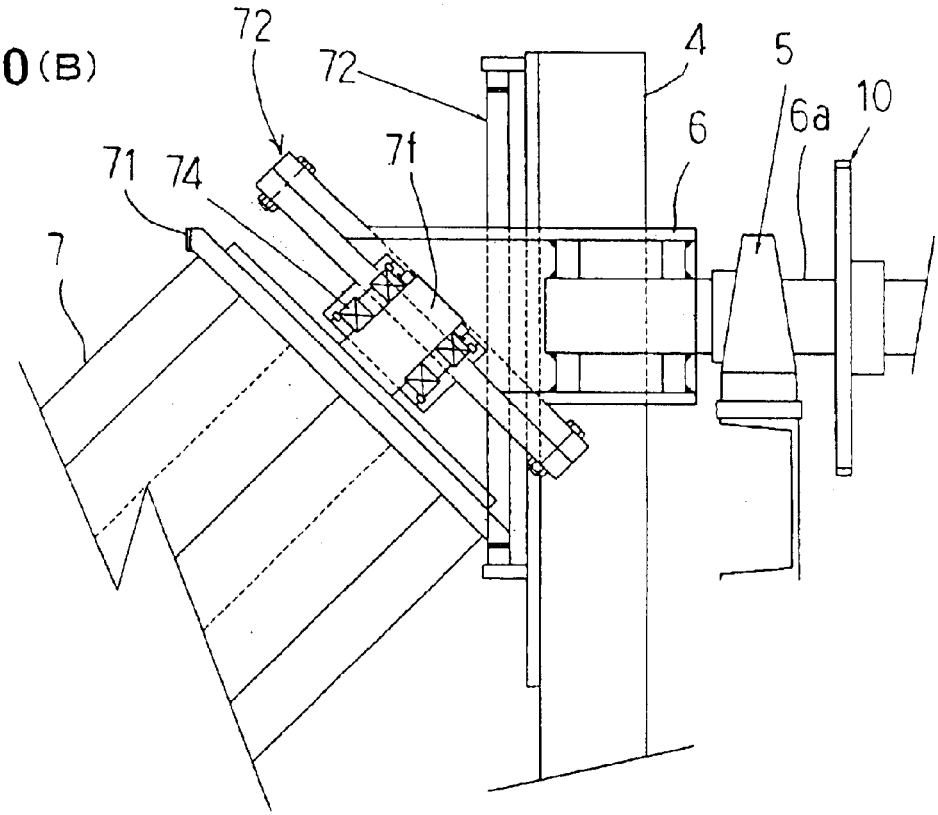
Figure 21:
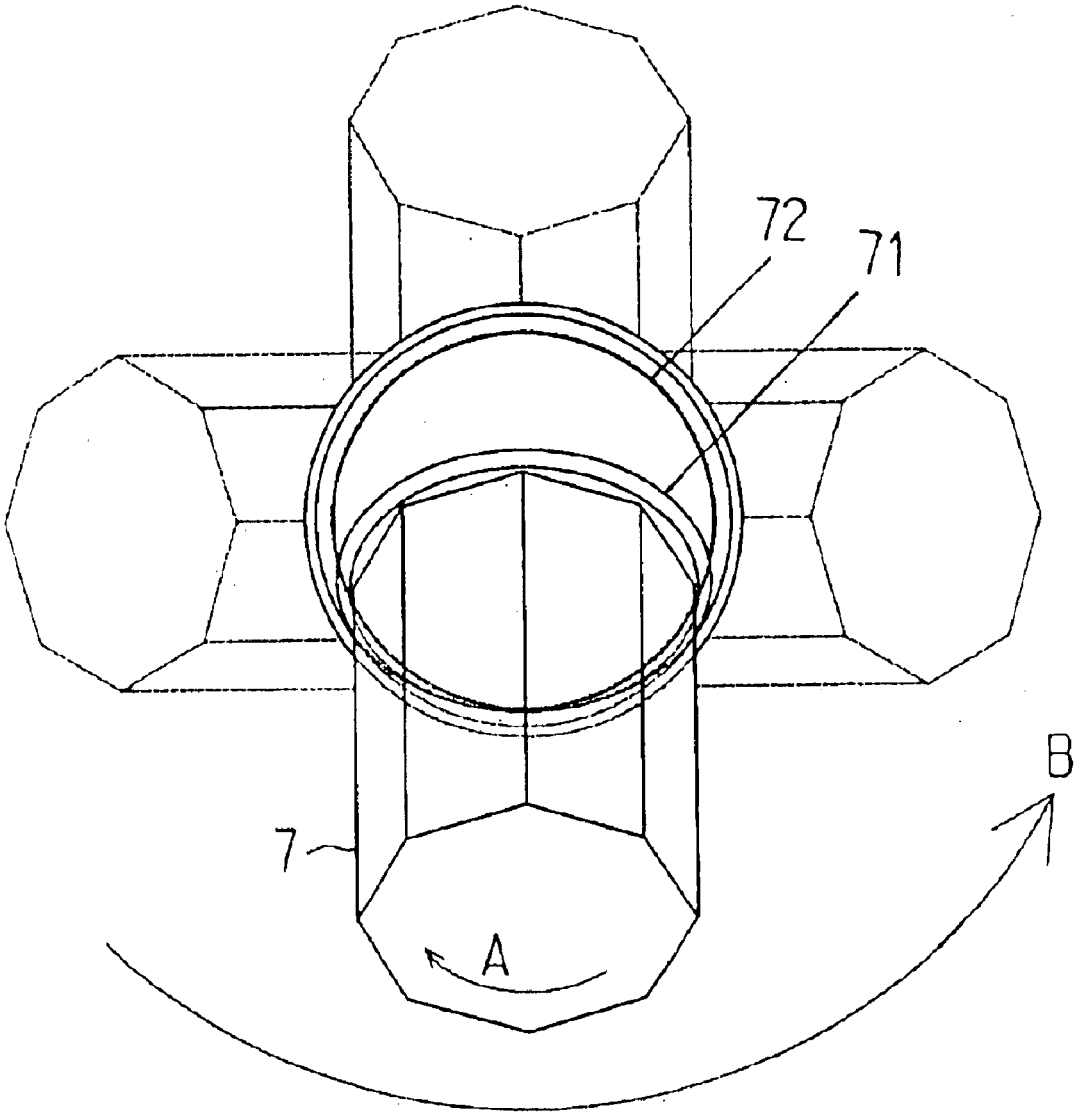
FIG. 21 is an illustration for explaining the works of the embodiment of FIGS. 20(A), 20(B)

FIGS. 20(A), 20(B) and FIG. 21 show another embodiment of the agitating and mixing device of the present invention, wherein FIG. 20(A) is a front view thereof, and FIG. 20(B) is a partially enlarged sectional view of FIG. 20(A), and FIG. 21 is an illustration for explaining the works thereof.

An agitating and mixing device of this embodiment comprises a frame 2, an adjustable speed motor (driving means) 3 attached to the frame 2, a support 4 standing on the frame 2, a main shaft 6*a* which is supported to an upper portion of the frame 2 via a bearing 5 such that the main shaft 6*a* is horizontally rotatable, a rotary shaft 6 fixed to the outer periphery of the main shaft 6*a*, a rotation converter 70 which is fixed to the rotary shaft 6 and is arranged to tilt relative to the rotary shaft 6, a polygonal container outer shell 7 rotatably supported to the rotation converter 70, a bevel gear 71 fixed to one side of the container outer shell 7, and a ring gear 72 secured to the support 4 coaxially with the rotary shaft 6. The bevel gear 71 and the inner teeth of the ring gear 72 are meshed with each other. The shaft 7*f* of the container outer shell 7 is connected to the rotation converter 70 via a bearing 74. The container outer shell 7 is provided with a flap lid 73 formed at the other side thereof.

In this embodiment, as the rotary shaft 6 is rotated, the container outer shell 7 is revolved, just like swing of one's head, in a direction of arrow B as shown in FIG. 21. In addition, by the revolution of the container outer shell 7, the bevel gear 71 is successively meshed and moved along the ring gear 72 so that the container outer shell 7 is rotated on its axis in a direction of arrow A, thereby effectively mixing two or more kinds of bulk materials. Loading of bulk materials into the container outer shell 7 is conducted by opening the flap lid 73 in a position shown by dotted lines and the discharge of the bulk materials is conducted in a position shown by solid lines in FIG. 20(A).

Figure 22:
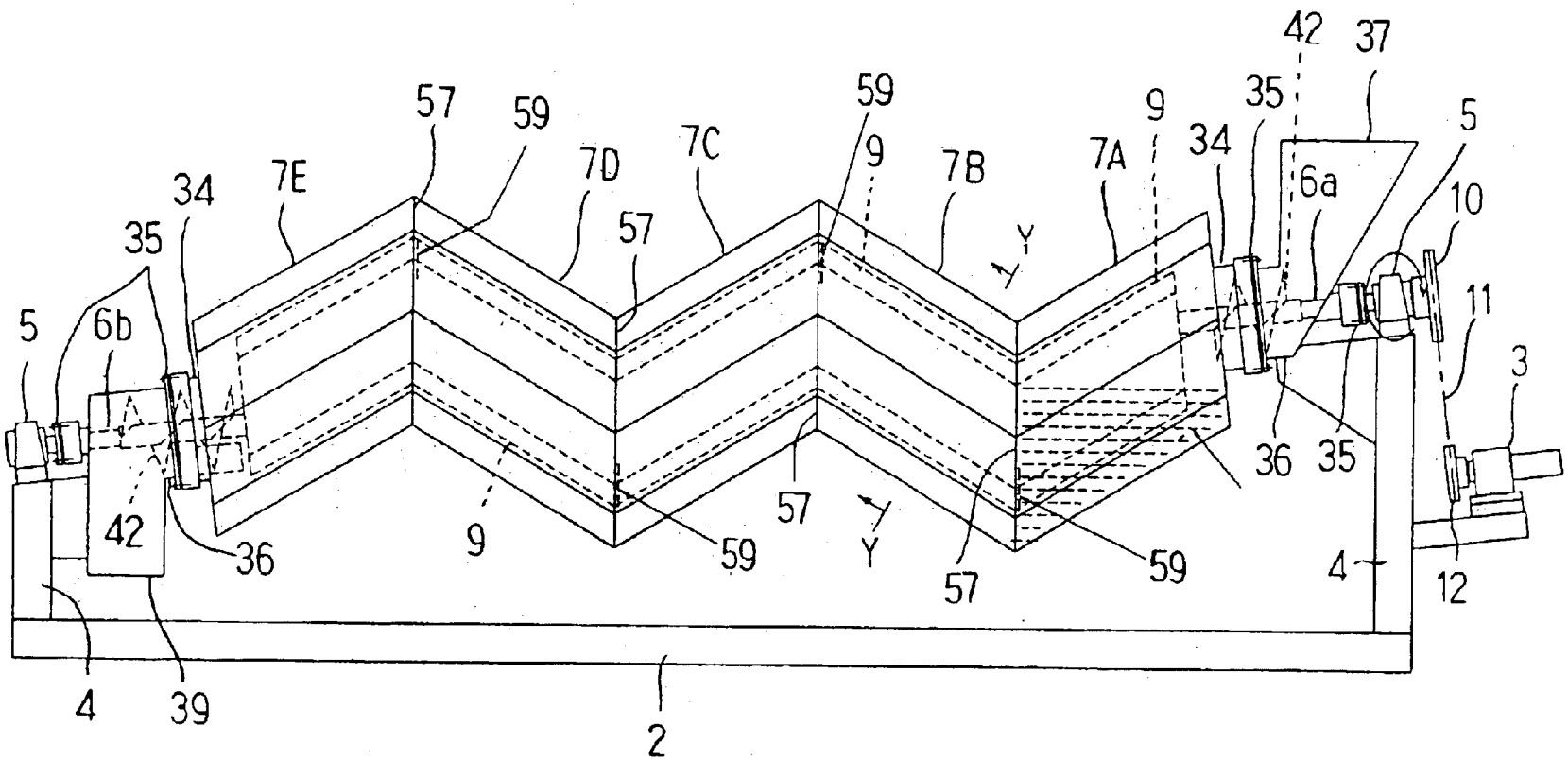
FIG. 22 is a front view showing further another embodiment of the agitating and mixing device of the present invention.
Figure 23A:
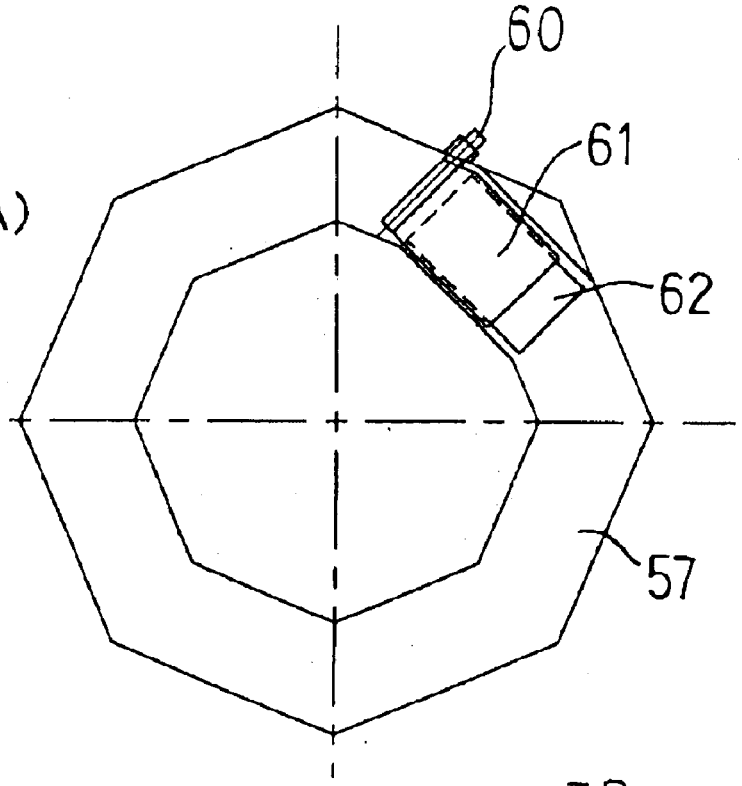
FIG. 23(A) is a sectional view taken along a line Y—Y in FIG. 22
Figure 23B:
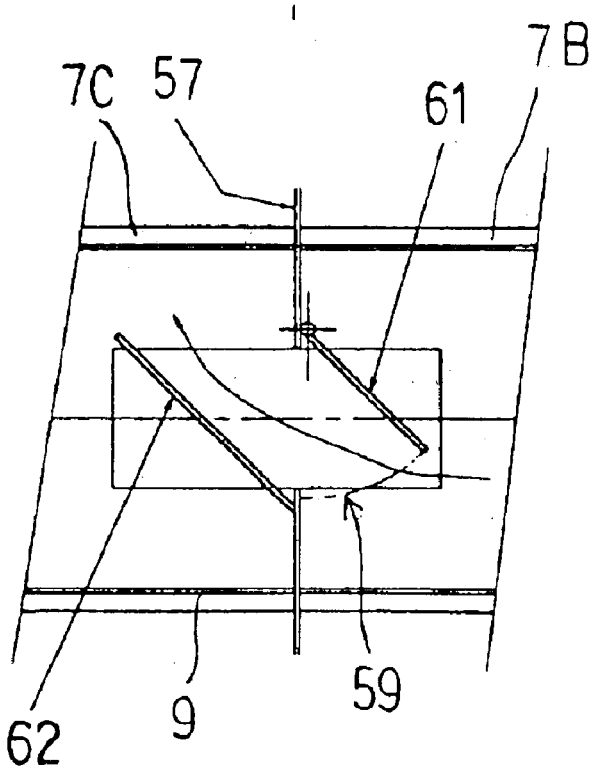
FIG. 23(B) is a sectional view showing main parts.

FIG. 22 and FIGS. 23(A), 23(B) show further another embodiment of the agitating and mixing device of the present invention, wherein FIG. 22 is a front view thereof, FIG. 23(A) is a sectional view taken along a line Y—Y in FIG. 22, and FIG. 23(B) is a sectional view showing main parts.

An agitating and mixing device 1 of this embodiment comprises a frame 2, an adjustable speed motor (driving means) 3 attached to the frame 2, a pair of supports 4, 4 standing on the frame 2, rotary shaft halves 6*a*, 6*b* which are rotatably supported to upper portions of the support 4, 4 by bearings 5, 5, respectively. A driven sprocket (or pulley) 10 is connected to one end of one rotary shaft half 6*a* and is coupled to a driving sprocket (or pulley) 12 via a chain (or belt) 11. The driving sprocket 12 is connected to the adjustable speed motor 3.

Between the rotary shaft halves 6*a* and 6*b*, a plurality of polygonal container outer shells 7A, 7B, 7C, 7D, 7E are continuously joined to each other via partition plates 57. The right-most container outer shell 7A and the left-most container outer shell 7B in FIG. 22 are fixed to tilt relative to the rotary shaft halves 6*a*, 6*b*, respectively and the middle container outer shells 7B, 7C, 7D are fixed to form V-like shapes as seen in the front view. Each of the container outer shells 7A–7E is provided with a polygonal inner shell 9 in the same manner as the aforementioned embodiments.

The rotary shaft half 6*a* is fixed to the inner shell 9 in the right-most container outer shell 7A. In addition, a rotary tube 34 similar to that shown in FIG. 12 is fixed to the container outer shell 7A and a stationary tube 36 is attached to the rotary tube 34 and the rotary shaft half 6*a* via rotary joints 35, 35. A feed hopper 37 is formed above the stationary tube 36. The rotary shaft half 6*a* is provided with a screw blade 42 along the rotary tube 34 and the stationary tube 36. On the other hand, the rotary shaft half 6*b* is fixed to the inner shell 9 in the left-most container outer shell 7B. In addition, a rotary tube 34 is fixed to the container outer shell 7E and a stationary tube 36 is attached to the rotary tube 34 and the rotary shaft half 6*b* via rotary joints 35, 35. A discharge hopper 39 is formed below the stationary tube 36. The rotary shaft half 6*b* is provided with a screw blade 42 along the rotary tube 34 and the stationary tube 36.

Each of the partition plates 57 between respective adjacent ones of the container outer shells 7A through 7E is formed with an opening 59 to which a flap door 61 is disposed such that the door 61 can pivot about a pivot 60 secured to the partition plate 57 as shown in FIGS. 23(A), 23(B). The flap door 61 is driven by a driving means, not shown, to control the open area of the opening 59. A guide plate 62 is arranged on the opposite side of the flap door 61 with respect to the opening 59 to prevent backflow of bulk materials while bulk materials flow in a direction of arrow in FIG. 23(B).

Hereinafter, works of this embodiment will be described. As bulk materials are supplied from the feed hopper 37 and the rotary shaft half 6*a* is rotated in the direction indicated by a solid-line arrow in FIG. 22, the bulk materials are supplied into the container outer shell 7A by the screw blade 42 and agitated and mixed between the container outer shell 7A and the inner shell 9. The bulk materials which have been agitated and mixed in the container outer shell 7A are scooped up by the flap door 61 during the flap door 61 is moved upward so that the bulk materials are conveyed along the guide plate 62 into the adjacent container outer shell 7B. During this, the flow rate of bulk materials is controlled by controlling the open area of the flap door 61. After that, the bulk materials are conveyed successively into the container outer shells 7C, 7D, 7E and are then discharged from the discharge hopper 39 by the screw blade 42.

As apparent from the above description, the agitating and mixing device according to the present invention comprises a rotary shaft to be rotated by a driving means, a container outer shell fixed to the rotary shaft to tilt relative to the rotary shaft, and an inner shell fixed inside the container outer shell. Bulk materials are put into a receiving space formed between the container outer shell and the inner shell and are then agitated and mixed. Therefore, uniform agitation and mixing of bulk materials is achieved with a simple structure.

It should be noted that bulk materials may be agitated and mixed by rotating the container outer shell and the inner shell in directions opposite to each other.

What we claim is:

1. An agitating and mixing device comprising:

a container comprising:

an outer polygonal cylinder having an axis; and an inner polygonal cylinder concentrically located inside the outer polygonal cylinder, to form a receiving space between the outer polygonal cylinder and the inner polygonal cylinder; and a rotary shaft fixed to the container, the rotary shaft being tilted relative to the axis, wherein the rotary shaft is rotated by a driving means, and wherein bulk materials are put into the receiving space.

2. An agitating and mixing device as claimed in claim 1, further comprising a wire arranged between the right side plate and the left side plate and inside the receiving space.

3. An agitating and mixing device as claimed in claim 1, wherein the inner shell is analogously fixed inside the container outer shell.

* * * * *